US007090512B2

(12) United States Patent
Laub et al.

(10) Patent No.: US 7,090,512 B2
(45) Date of Patent: Aug. 15, 2006

(54) CONNECTOR SYSTEM FOR CONDUCTIVE PLATES

(75) Inventors: Michael F. Laub, Harrisburg, PA (US); Alexandra L. Spitler, Palmyra, PA (US); Charles R. Malstrom, Lebanon, PA (US)

(73) Assignee: Tyco Electronics Corporatin, Middletown, PA (US)

( * ) Notice: Subject to any disclaimer, the term of this patent is extended or adjusted under 35 U.S.C. 154(b) by 0 days.

(21) Appl. No.: 10/966,326

(22) Filed: Oct. 15, 2004

(65) Prior Publication Data

US 2006/0084295 A1 Apr. 20, 2006

(51) Int. Cl.
*H01R 12/00* (2006.01)

(52) U.S. Cl. ..... 439/79

(58) Field of Classification Search ..... 439/79, 439/630, 857, 861, 862; 429/34, 13
See application file for complete search history.

(56) References Cited

U.S. PATENT DOCUMENTS

| | | | | | |
|---|---|---|---|---|---|
| 4,253,719 | A | | 3/1981 | McGinley | 339/61 M |
| 4,572,604 | A | * | 2/1986 | Ammon et al. | 439/633 |
| 5,024,610 | A | | 6/1991 | French et al. | 439/857 |
| 5,269,712 | A | * | 12/1993 | Denlinger et al. | 439/845 |
| 5,564,952 | A | | 10/1996 | Davis | 439/682 |
| 5,683,267 | A | * | 11/1997 | Ribbeck et al. | 439/395 |
| 5,743,751 | A | * | 4/1998 | Davis et al. | 439/79 |
| 5,749,751 | A | | 5/1998 | Shortt et al. | 439/721 |
| 5,763,113 | A | | 6/1998 | Meltser et al. | 429/13 |
| 6,146,202 | A | * | 11/2000 | Ramey et al. | 439/608 |
| 6,231,355 | B1 | * | 5/2001 | Trammel et al. | 439/79 |
| 6,238,245 | B1 | * | 5/2001 | Stokoe et al. | 439/608 |
| 6,312,265 | B1 | * | 11/2001 | Mohtar et al. | 439/79 |
| 6,341,988 | B1 | * | 1/2002 | Zhu et al. | 439/630 |
| 6,688,897 | B1 | * | 2/2004 | Korsunsky et al. | 439/108 |
| 6,786,762 | B1 | * | 9/2004 | Buck et al. | 439/493 |
| 6,790,055 | B1 | * | 9/2004 | Shiu et al. | 439/79 |
| 2002/0164517 | A1 | | 11/2002 | Sato et al. | 429/34 |

* cited by examiner

*Primary Examiner*—Alexander Gilman

(57) ABSTRACT

An electrical connector for mating with a conductive plate having a plate mounting edge, and first and second surfaces extending from the plate mounting edge is provided. The connector includes a contact having a contact mounting edge and a lead interface edge opposite the contact mounting edge. A first contact beam and a second contact beam extend from the contact mounting edge, and the first contact beam is configured to engage the first surface of the plate when passed over the plate mounting edge. The second contact beam is configured to engage the second surface of the plate when passed over the plate mounting edge, and the first and second contact beams are laterally offset from one another along the contact mounting edge. At least one lead contact extends from the lead interface edge, and the lead contact is configured to mate with a mating connector.

17 Claims, 8 Drawing Sheets

CONNECTOR SYSTEM FOR CONDUCTIVE PLATES

BACKGROUND OF THE INVENTION

This invention relates generally to electrical connectors, and more specifically, to electrical connectors which interface to conductive plates.

Certain electrical systems include one or more conductive plates, and it is sometimes desirable to electrically connect the conductive plates to external equipment for diagnostic, testing, and monitoring purposes. Such constructions are employed in existing and emerging technologies, and introduce new demands on electrical connectors. For example, fuel cell technology utilizes a large number of conductive plates arranged in a stack, and it is desirable to monitor a voltage on the individual plates during operation. Establishing reliable electrical and mechanical connection to the plates, however, has proven difficult.

For example, electrical contacts in connectors used for such purposes should be of a low contact resistance to permit easy installation onto the plates, yet mechanically stable when attached to the conductive plates and not prone to separating from the plates in use. The connector and contacts should also be reliably engaged to the plates and disengaged from the plates as needed or as desired, while still providing the desired electrical connection and mechanical stability. Known contacts and connectors are not suitable for these purposes.

Additionally, in certain electrical systems, the conductive plates are fabricated from composite materials rather than from conventional metallic materials. While composite materials may be advantageous for the electrical system, the composite materials tend to complicate the mechanical and electrical interface between the plates and the connector. Conventional connectors are poorly suited for use with such composite materials.

Still further, in systems having stacked electrical components, such as fuel cells, expansion and contraction of the plates at different operating temperatures may result in mechanical load and stress on electrical contacts and connectors engaged to the plates. Thermal stress tends to dislodge the contacts from the plates and can frustrate proper diagnostic, testing, and monitoring procedures for the plates.

BRIEF DESCRIPTION OF THE INVENTION

According to an exemplary embodiment, an electrical connector for mating with a conductive plate is provided. The plate has a plate mounting edge, and first and second surfaces extending from the plate mounting edge, and the connector comprises a contact comprising a contact mounting edge and a lead interface edge opposite the contact mounting edge. A first contact beam and a second contact beam extend from the contact mounting edge, and the first contact beam is configured to engage the first surface of the plate when passed over the plate mounting edge. The second contact beam is configured to engage the second surface of the plate when passed over the plate mounting edge, and the first and second contact beams are laterally offset from one another along the contact mounting edge. At least one lead contact extends from the lead interface edge, and the lead contact is configured to mate with a mating connector.

Optionally, the contact further comprises a compliant body section extending between the contact mounting edge and the lead interface edge. A substantially planar body section is provided, and a plurality of openings extend through the body section. Compliant web sections are located between the openings, wherein the compliant web sections permit the body section to flex about the compliant web sections and relieve mechanical stress upon the first and second contact beams. A housing and a retaining bar may be provided, and the retaining bar may be configured to secure the housing to the plate. Insulating flanges may be provided in the housing, and the flanges may be configured to prevent the beams from contacting an adjacent plate when a plurality of plates are stacked in an electrical system.

In accordance with another exemplary embodiment, an electrical system comprises a conductive plate having a mounting interface edge, a first surface extending from the mounting edge and a second surface extending from the mounting edge opposite the first surface. The plate is configured for stacking in a component assembly. The system also comprises a connector comprising a housing configured to slidably engage the plate mounting edge, and a contact in the housing and configured to engage the first surface and the second surface of the plate mounting edge. A non-conductive retention bar, unattached to the housing, is configured to retain the housing to the plate.

According to another exemplary embodiment, an electrical system comprises a plurality of electrical components arranged in line with one another and spaced from one another by a nominal pitch value, each of the components having a component mounting edge configured to receive an electrical connector. A plurality of electrical connectors are attached to the respective electrical components, and each of the plurality of the connectors comprises a housing configured to slidably engage the component mounting edge of the respective electrical components. Each of the connectors also comprise a contact comprising first and second contact beams extending from the housing, and the first and second contact beams are configured to engage opposite surfaces of the plate adjacent the component mounting edge. Each connector further includes a non-conductive retention bar unattached to the housing, and the retention bar is configured to retain the housing to the respective electrical component proximate the component mounting edge.

DETAILED DESCRIPTION OF THE INVENTION

Figure 1:
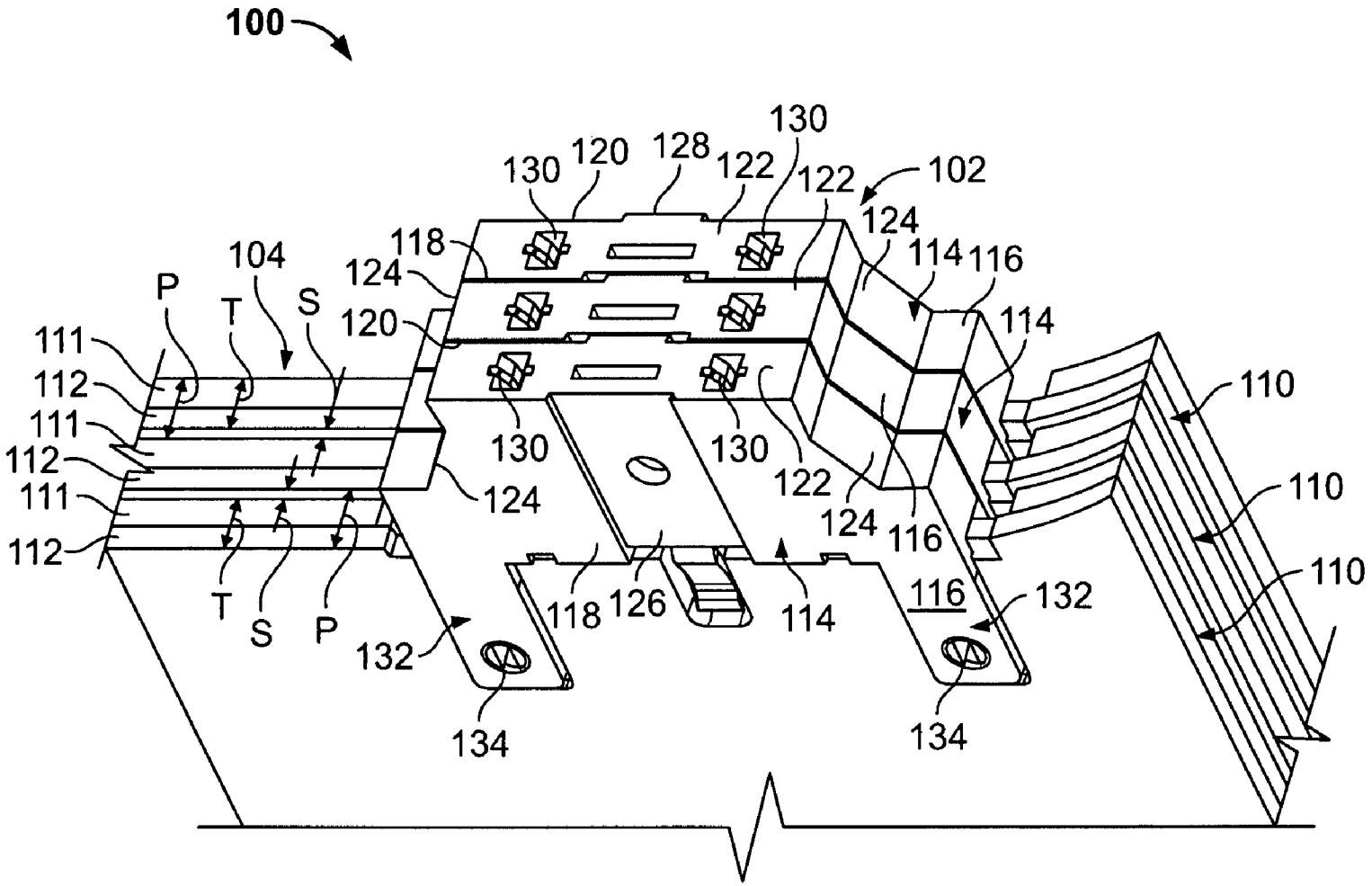
FIG. 1 is a partial perspective view of an exemplary electrical system including a connector assembly formed in accordance with an exemplary embodiment of the present invention.

FIG. 1 is a partial perspective view of a portion of an exemplary electrical system 100 including an exemplary connector assembly 102 which may reliably establish mechanical and electrical connection to conductive plates in the system 100 and which overcomes the aforementioned problems and difficulties of known connectors when used in such a system.

In an exemplary embodiment, the connector assembly 102 interfaces a fuel cell 104 with a monitoring device (not shown in FIG. 1) via interface links (not shown in FIG. 1) described below. The interface links are connected, in turn, to a monitoring module (not shown in FIG. 1) which processes signals transmitted from the fuel cell 104 through the connector assembly 102 and the interface links. Thus, the monitoring module may be used to monitor the operation of the fuel cell 104 for monitoring, testing and/or diagnostic purposes. While the connector assembly 102 is described and illustrated herein in the context of interfacing a fuel cell 104 with a monitoring module, it is contemplated that the benefits of the invention accrue to other applications of the connector assembly 102, and the fuel cell 104 is but one exemplary apparatus in which the benefits of the invention may be realized. Consequently, the description set forth herein is for illustrative purposes only and is not intended to limit the invention to any particular end use or application.

In an illustrative embodiment, the fuel cell 104 is a known unit which reacts a gaseous fuel, such as reformed natural gas, with air to produce electrical power in a known manner. The fuel cell 104 includes a number of bipolar conductive plates 110, and each of the conductive plates includes a first plate portion 111 and a second plate portion 112 which are adhesively bonded to one another. Additionally, in one embodiment the conductive plates 110 are fabricated from a composite material, such as a known conductive polymeric material or polymeric composition rather than from conventional metallic materials. It is understood, however, that the embodiments of the present invention may be used with conventional metal plates in addition to or in lieu of composite plates.

As explained below, plate contacts (not shown in FIG. 1) are attached to each of the plates 110, and the plate contacts permit the monitoring module, via the connector assembly 102, to monitor a voltage on corresponding plates 110 of the fuel cell 104 during operation. Each plate 110 in the fuel cell has a predetermined nominal thickness T, and the plates 110 are arranged in a stack with a predetermined nominal spacing value S between the plates 110, the sum of which is sometimes referred to as a nominal pitch value P for the plates 110. That is, the stack of plates 110 is designed to have a reoccurring dimension P measured in a direction perpendicular to the plane of the plates 110 from an edge of one plate across the thickness of the plate to the edge of an adjacent plate. In theory, according to design parameters, the plates 110 are repeated at a uniform distance P in the fuel cell stack. In reality, each of the plate thickness and the spacing of the plates is subject to manufacturing tolerances, and an actual dimension P may deviate somewhat from the nominal value of the sum of the plate thickness T and the nominal spacing value S for any two adjacent plates 110 in the fuel cell 104.

The connector assembly 102 includes a number of discrete connectors 114, and one of the connectors 114 is connected to each of the plates 110 in the stack. By having a one-to-one correlation of plates 110 and connectors 114, the connectors 114 may be fixed to the plates 110 so that the positions of each connector 114 relative to the respective plate 110 is assured even though the position of the plates 110 relative to one another (i.e., the dimension P between adjacent plates) may vary. Reliable and secure mechanical and electrical connections between the plates 110 and the connectors 114 may therefore be established despite some deviation in the nominal pitch spacing P of the plates 110.

Each of the connectors 114 includes an insulative (i.e., nonconductive) housing 116 having opposite side faces 118 and 120 spaced apart from one another by the thickness T of the plates 110, and a mating face 122 extending between the side faces 118, 120. The housings 116 further include end edges 124 extending between the side faces 118, 120 on opposing ends of the mating face 122. The side faces 118, 120, the mating face 122, and the end edges 124 encompass a cavity or receptacle therebetween for a plate contact (not shown in FIG. 1 but described below) which engages the respective plate 110 in the stack.

In an exemplary embodiment, and as illustrated in FIG. 1, one of the side faces 118 of each housing 116 includes a slot 126, while the other of the side faces 120 includes an insulating flange 128. When the plates 110 are stacked, the flanges 128 are nested within the slots 126, and the flanges 128 prevent the contact beams from contacting adjacent plates and shorting the plates. A pair of openings or receptacles 130 are provided in the mating face 122 of each housing 116, and the receptacles 130 receive a mating connector described below to establish electrical connection between the plate contact in the housing 116 and the monitoring module. Mounting legs 132 depend downwardly from the side faces 118 in a direction way from the mating face 122, and each mounting leg 132 includes a retention aperture 134 which receives a retention bar (not shown in FIG. 1) to secure the housing 116 to the respective plate 110.

Figure 2:
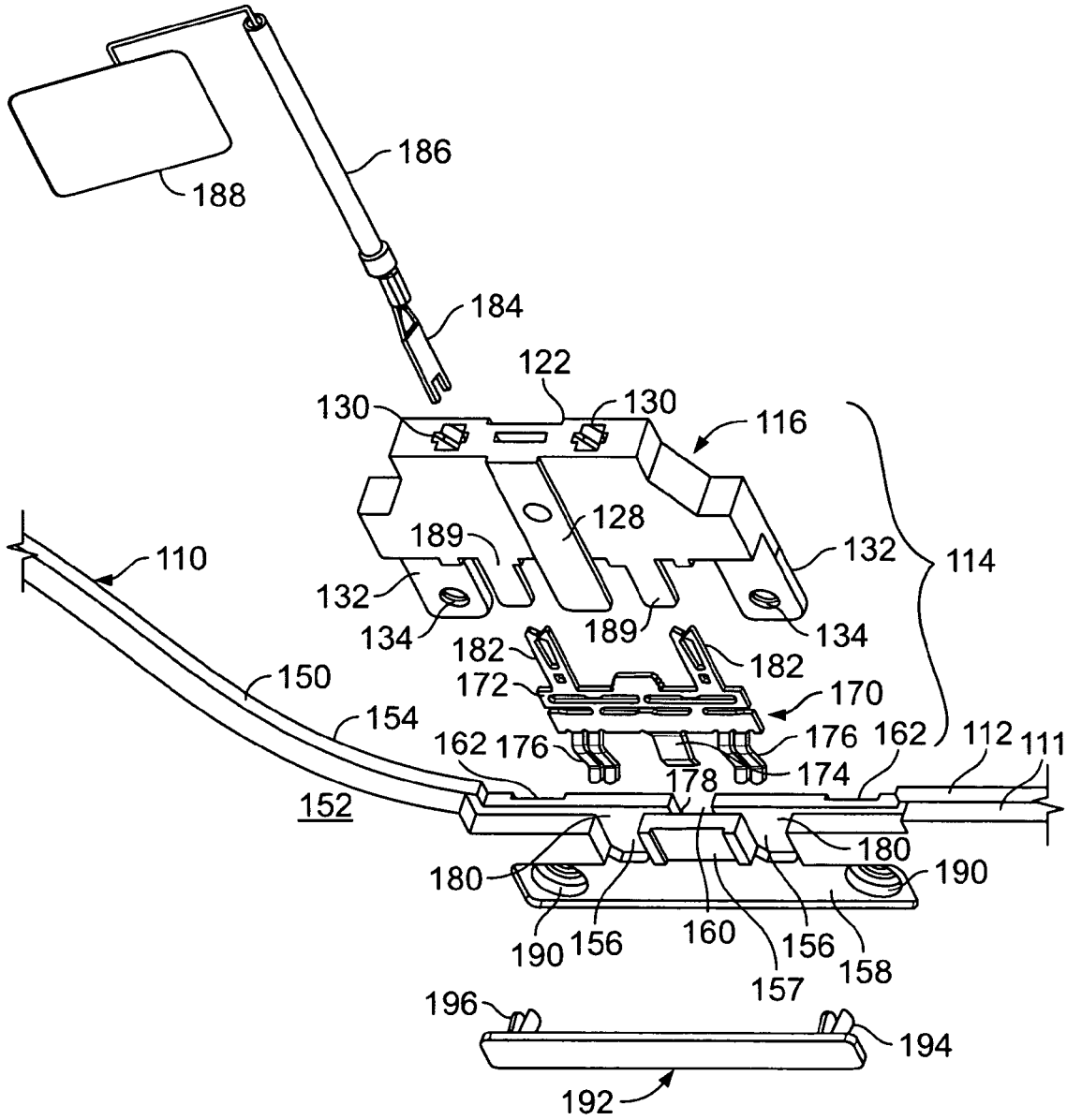
FIG. 2 is an exploded view of a portion of the system shown in FIG. 1.

FIG. 2 is an exploded view of a portion of the system 100 (shown in FIG. 1) and illustrating one of the connectors 114 and one of the plates 110. The plate 110 includes a mounting edge 150 which receives the connector 114, and opposite side faces or surfaces 152, 154 extending from the mounting edge 150 and corresponding to the outer surfaces of the first plate portion 111 and the second plate portion 112 defining the bipolar plate 110. The first portion 111 includes first and second contact slots 156 and a guide channel 157 therebetween, and each of the slots 156 and the channel 157 are located adjacent the plate mounting edge 150. A recessed retention area 158 extends beneath the slots 156 and the guide channel 157.

The second plate portion 154 includes a contact slot 160 positioned between the first plate portion slots 156 and opposite the guide channel 157. Recessed grooves 162 are also provided in the second plate portion 112 on either side of the slot 160.

In an exemplary embodiment the connector 114 includes the housing 116 and a plate contact 170. The plate contact 170 includes a body section 172, a center contact beam 174 extending downward from the body section 172 and first and second outer contact beams 176 extending from the body section 172 on either side of the center contact beam 174. The contact beams 174 and 176 are constructed to pass over or be moved over and received upon the plate mounting edge 150. When passed over the plate mounting edge 150, the center contact beam 174 is received in the second plate portion slot 160, and the outer contact beams 176 are received in the first plate portion slots 156. As such, the center contact beam 174 engages an inner surface 178 of the first plate portion 111 exposed by the slot 160 and located behind the guide channel 157, and the outer contact beams 176 engage an inner surface 180 of the second plate portion 112 exposed by the slots 156.

First and second lead contacts 182 extend upward from the body section 172 and into the housing 116. The lead contacts 182 are exposed in the receptacles 130 of the mating face 122. The lead contacts 182 establish an electrical connection with a mating contact 184 when the contact 184 is inserted into one of the receptacles 130. In an exemplary embodiment, the mating contact 184 is coupled to an interface link in the form of a wire 186 which is connected to a known monitoring module 188 which may be employed, for example, to monitor an operating voltage of the plate 110 in the fuel cell stack.

The insulating flange 128 of the connector housing 116 is slidably received in the guide channel 157, and the mounting legs 132 are each received in the recessed grooves 162. The insulating flanges 189 depend from the housing 116 and overlie the outer contact beams 176 to shield the beams 176 from inadvertent contact and prevent the outer contact beams 176 from shorting with an adjacent plate 110. The retention apertures 134 in the mounting legs 132 are aligned with retention apertures 190 extending through the plate 110, and a retention bar 192 is fitted into the retention area 158 of the first plate portion 111.

The retention bar 192 includes retention posts 194, 196 which are inserted into the plate apertures 190 and through the mounting leg apertures 134. In the illustrated embodiment, the retention posts 194, 196 are bifurcated posts which resiliently deflect as they are inserted through the apertures 190 and 134, and then resiliently snap or return to a locked position securely retaining the mounting legs 132 to the plate 110. In an alternative embodiment, the retention posts 194, 196 are fabricated as a solid construction having a dimension slightly larger than the mounting leg apertures 134, and thus retain the connector housing 116 to the plate 110 with a force fit or interference fit.

The retention bar 192 is fabricated from a non-conductive material (e.g., plastic) in an exemplary embodiment, and is separately provided from the connector housing 116. The retention bar 192 is easily installed once the connector 104 is engaged to the plate 110, and the retention bar 192 may be manufactured economically while providing secure engagement of the connector housing 116 to the plate 110. In different embodiments, the retention bar 192 may be installed before or after the connector housing 116 and the plate contact 170 are installed past the plate mounting edge 150. That is, the retention posts could be inserted through the mounting leg apertures 134 after the housing 116 and the plate contact 170 are slidably engaged to the plate 110, or the mounting legs 132 could be slid past the plate mounting edge 150 and snapped over the retention posts 194, 196 if the retention bar 192 is previously installed.

Figure 3:
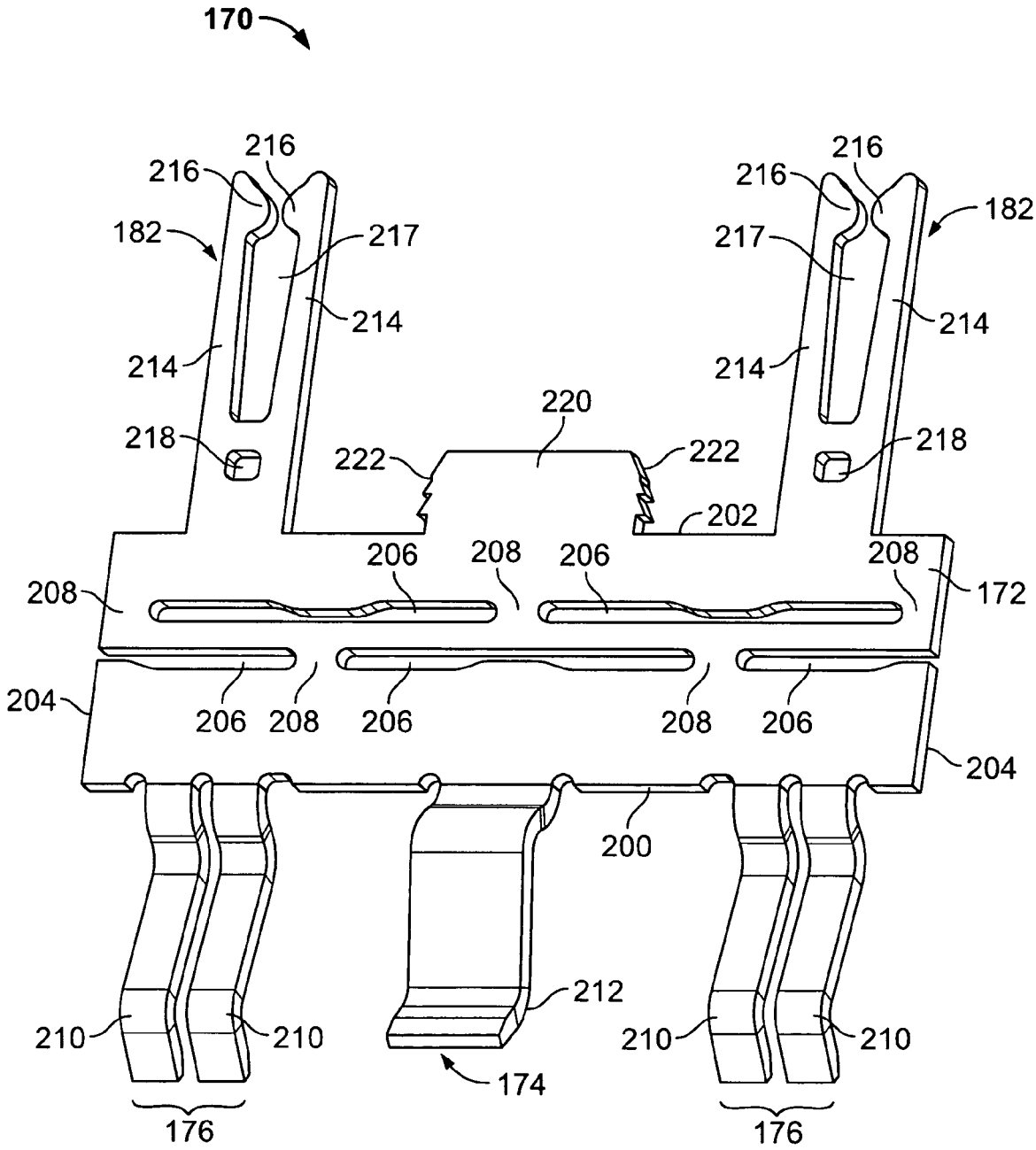
FIG. 3 is a perspective view of an exemplary contact for the connector shown in FIG. 2.

FIG. 3 is an enlarged perspective view of the plate contact 170 shown in FIG. 2. The body section 172 is generally planar and rectangular in an exemplary embodiment, and includes a contact mounting edge 200, a lead interface edge 202, and side edges 204 extending between the contact mounting edge 200 and the lead interface edge 202. The body section 172 includes a number of elongated openings 206 extending therethrough and aligned in rows extending between the contact side edges 204. The openings 206 define thin web sections 208 extending between adjacent openings 206. The web sections 208 have a greatly reduced cross sectional area than the remainder of the body section 172, and consequently the web sections 208 have reduced structural strength and resistance to bending forces in the area of the web sections 208. Thus, by virtue of the openings 206 and the web sections 208, the body section 172 may bend or flex about the web sections 208 and relieve mechanical stress on the contact beams 174 and 176 which may otherwise tend to dislodge the beams 174 and 176 from the associated plate 110 (shown in FIGS. 1 and 2). As such, the body section is compliant.

The outer contact beams 176 extend from the contact mounting edge 200, and are distanced laterally from the center contact beam 174 such that the center contact beam 174 is located between the outer of contact beams 176. In one embodiment, each outer contact beam 176 includes a pair of contact beams. The contact beams 176 extend obliquely to the compliant body section 172 and include rounded contact surfaces 210 which engage the inner surface 180 of the second plate portion 112 (shown in FIG. 2). The contact surfaces 210 wipe against the plate 110 as the plate contact 170 is installed, and the oblique angle of the beams 176 generates a normal contact force against the plate 110 as the beams 176 are engaged to the plate 110 and the beams 176 are deflected.

The center contact beam 174 also extends obliquely to the body section 172 and includes a rounded contact surface 212 which engages the inner surface 178 of the first plate portion 111 (shown in FIG. 2). The contact surface 212 wipes against the plate 110 as the plate contact 170 is installed, and the oblique angle of the beam 174 generates a normal contact force against the plate 110 as the beam 174 is engaged to the plate 110 and the beam 174 is deflected.

In an exemplary embodiment, the center contact beam 174 and the outer contact beams 176 are angled in opposite directions from one another along the contact mounting edge 200. The contact surfaces 210 of the outer contact beams 176 and the contact surface 212 of the center contact beam 174 therefore face in opposite directions from one another, and the beam 174 and the beams 176 are deflected in opposite directions when they are inserted over the plate mounting edge 150 (shown in FIG. 2). Thus, by virtue of the contact beams 174, 176 being angled in different directions, normal force contact is provided in opposite directions when the beams 174 and 176 are deflected. The plate contact 170 is therefore installed onto the plate 110 as a clip, and to a certain degree is self retaining in a stable manner due to the lateral offset of the outer pairs of contact beams 176 with respect to the center contact beam 174. Moreover, multiple contact surfaces 210, 212 provided by multiple beams 174 and 176 provides redundant points of contact and ensures an adequate electrical connection to the plate 110 when the plate contact 170 is installed on the plate 110. While five contact beams (one center beam 174 and four outer beams 176) are illustrated in FIG. 3, it is understood that greater or fewer contact beams could be provided in alternative embodiments.

A pair of lead contacts 182 extends from the lead interface edge 202 of the body section 172, and the lead contacts 182 correspond to the receptacles 130 in the connector housing 116 (shown in FIG. 2). In an illustrative embodiment, the lead contacts 182 are tuning fork contacts having a pair of deflectable beams 214 facing one another. The deflectable beams 214 include rounded guide projections 216 on distal ends thereof which align a mating contact 184 (shown in FIG. 2) with the beams 214, and as the mating contact 184 is inserted the beams 214 are deflected and the mating contact 184 is received in an open space 217 between the beams. The lead contacts 182 also include retention apertures or windows 218 adjacent the deflectable beams 214. The retention windows 218 are utilized to retain the mating contact 184 as explained below. While tuning fork contacts are illustrated for the lead contacts 182, it is recognized that other types of contacts may be employed as desired to interface with a mating contact in alternative embodiments.

A housing retention barb 220 is also provided and extends from the lead interface edge 202 and is approximately centered between the lead contacts 182. Side edges 222 of the barb 220 are roughened and penetrate a portion of the connector housing 116 (shown in FIG. 2) to firmly retain the plate contact 170 into the housing 116.

The plate contact 170, including the body section 172, the contact beams 174 and 176, the lead contacts 182 and the retention barb 220 may be stamped, formed and plated using conductive materials according to known manufacturing processes and techniques. Once the plate contacts 170 are assembled into the housings 116 to complete the connectors 114, the connectors 114 may be inserted onto the bipolar plates 110 and held securely in place by installing the retention bar 192 (shown in FIG. 2).

Figure 4:
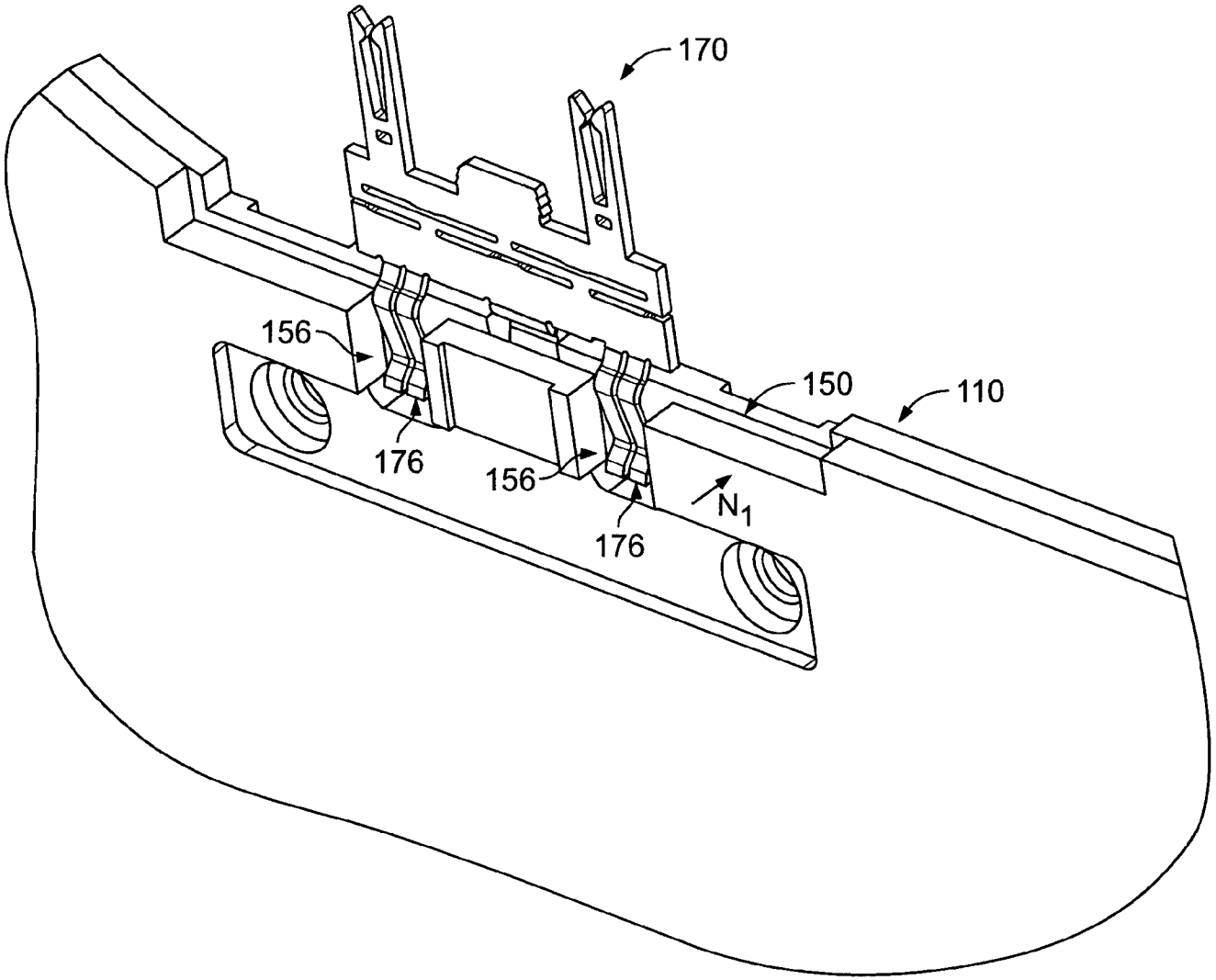
FIG. 4 is a partial assembly view of the system shown in FIGS. 1 and 2.
Figure 5:
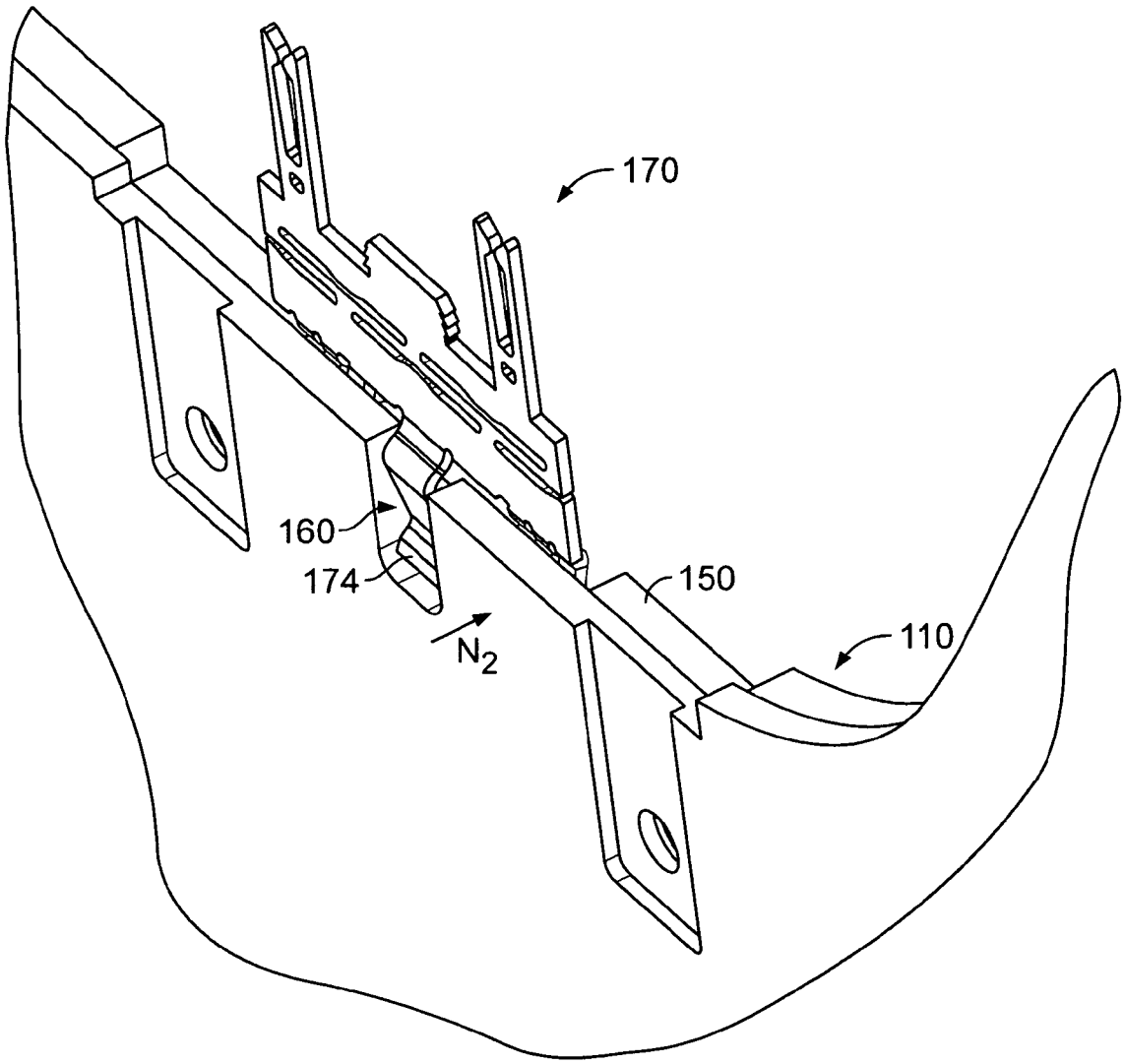
FIG. 5 is another partial assembly view of the system shown in FIGS. 1 and 2.

FIGS. 4 and 5 illustrate a plate contact 170 engaged to one of the plates 110. The contact beams 174 and 176 of the plate contact 170 are inserted over the plate mounting edge 150, and the contact beams 174 and 176 engage opposite surfaces of the plate 110. The outer contact beams 176 are received in the first plate portion slots 156, and the center contact beam 174 is received in the second plate portion slot 160. Deflection of the outer contact beams 176 produces a normal contact force $N_1$ (FIG. 4) on one surface of the plate 110, and deflection of the center contact beam 174 produces a normal contact force $N_2$ (FIG. 5) on the other surface of the plate 110. The contact 170 is therefore securely engaged to the plate 110.

Figure 6:
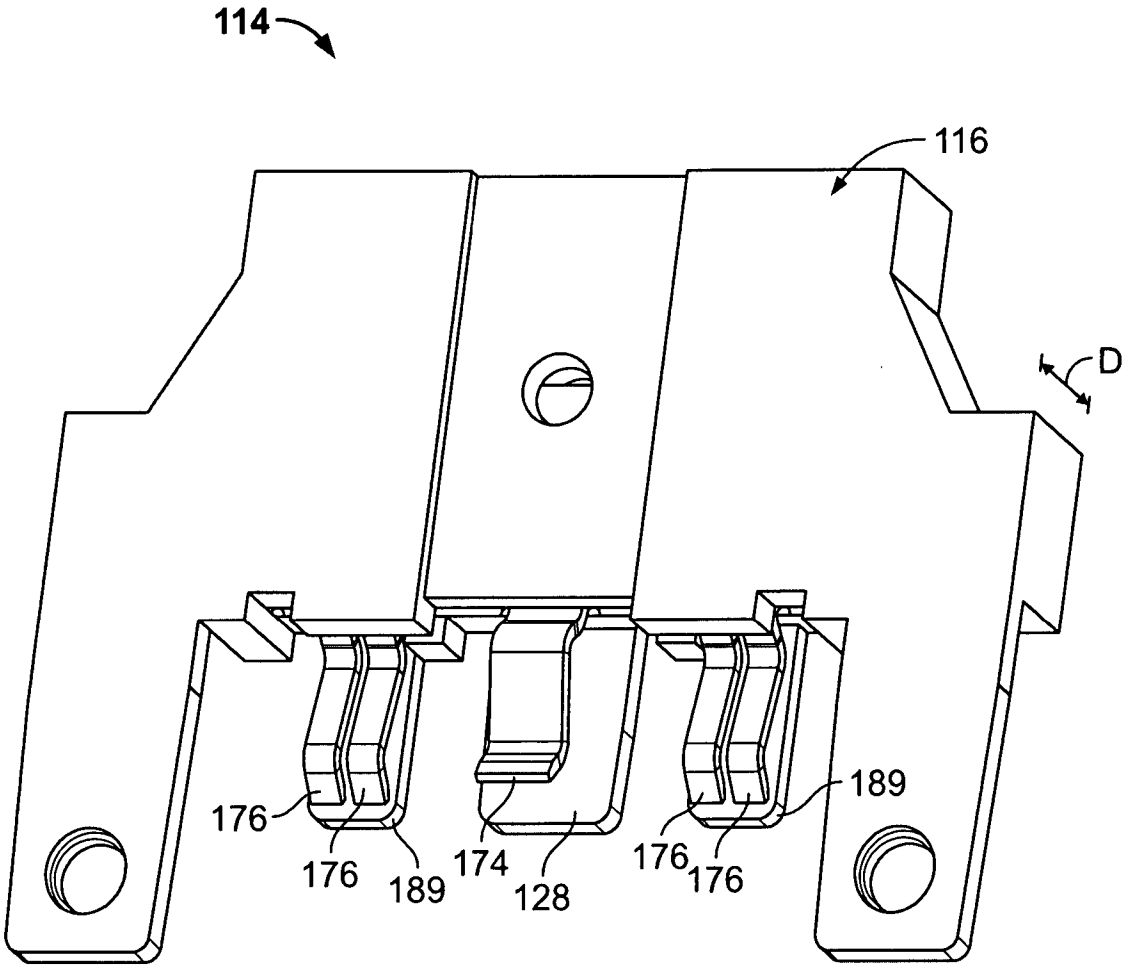
FIG. 6 is an assembled view of the connector shown in FIGS. 1 and 2.

FIG. 6 is an assembled view of the connector 114 having the plate contact 170 (shown in FIGS. 2–5) installed within the connector housing 116. The contact beams 174 and 176 of the plate contact 170 are exposed through a lower end of the connector housing 116. The flange 128 extend from the housing 116 near the center contact beam 174 and the flanges 189 extend from the housing 116 near the outer contact beams 176. The housing 116 is constructed to have a dimension D measured perpendicular to the plate which is approximately the plate thickness T (FIG. 1) or less such that the dimension D therefore does not interfere with the plate-to-plate spacing or the pitch P (FIG. 1) between adjacent plates 110 when the plates are stacked.

Figure 7:
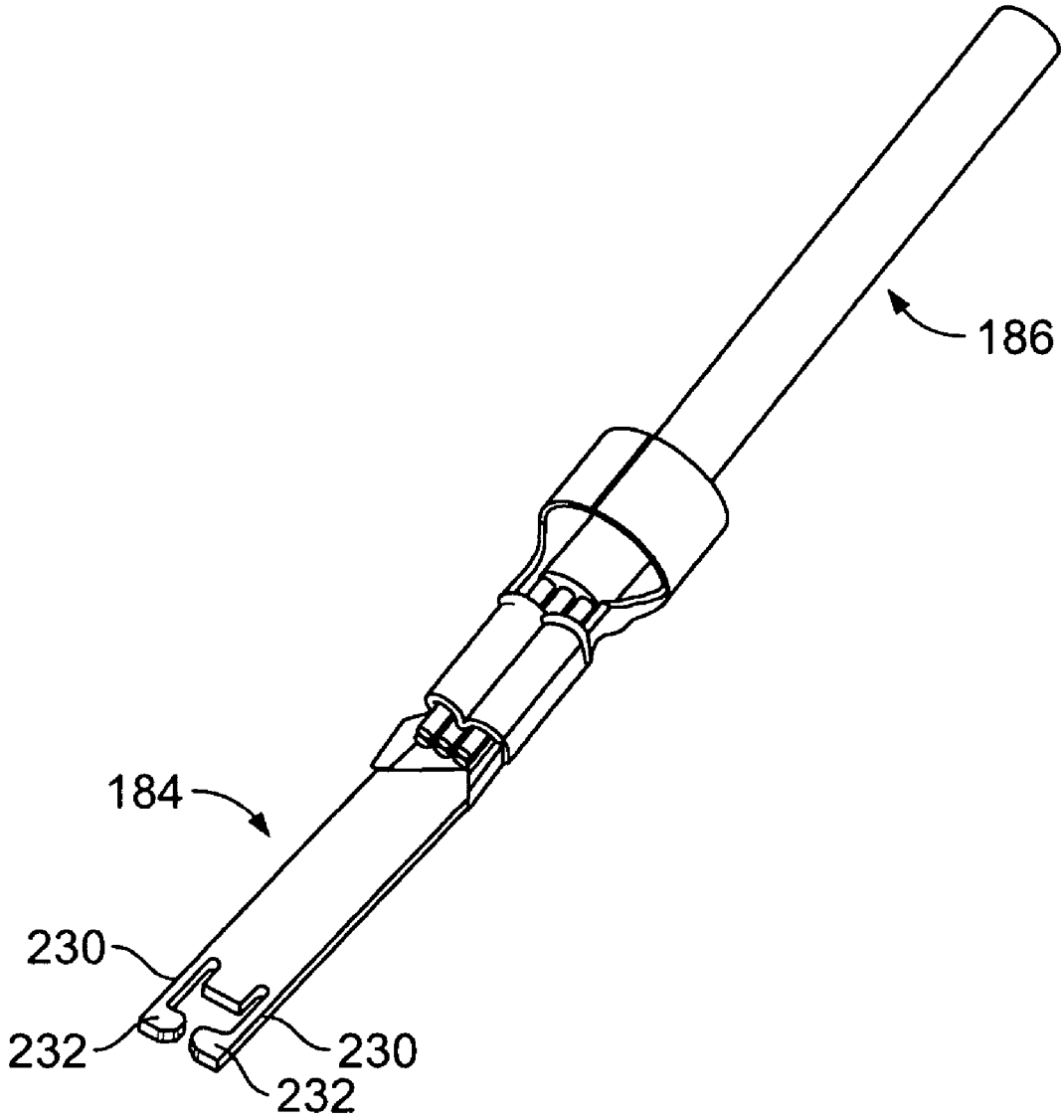
FIG. 7 is a perspective view of a mating connector for the system shown in FIG. 1.

FIG. 7 is a perspective view of a mating contact 184 for the lead contacts 182 (FIGS. 2 and 3) of the plate contact 170. In an exemplary embodiment, the mating connector 184 is a blade contact crimped to the end of a discrete wire 186. The mating contact 184 includes deflectable beams 230 on a distal end thereof, and the beams 230 include protrusions 232 which engage retention windows 218 (FIG. 3) of the lead contacts 182. The beams 230 deflect during insertion of the mating contact 184 and provide residual force that ensures adequate retention force of the mated contact 184 to the lead contacts 182.

Figure 8:
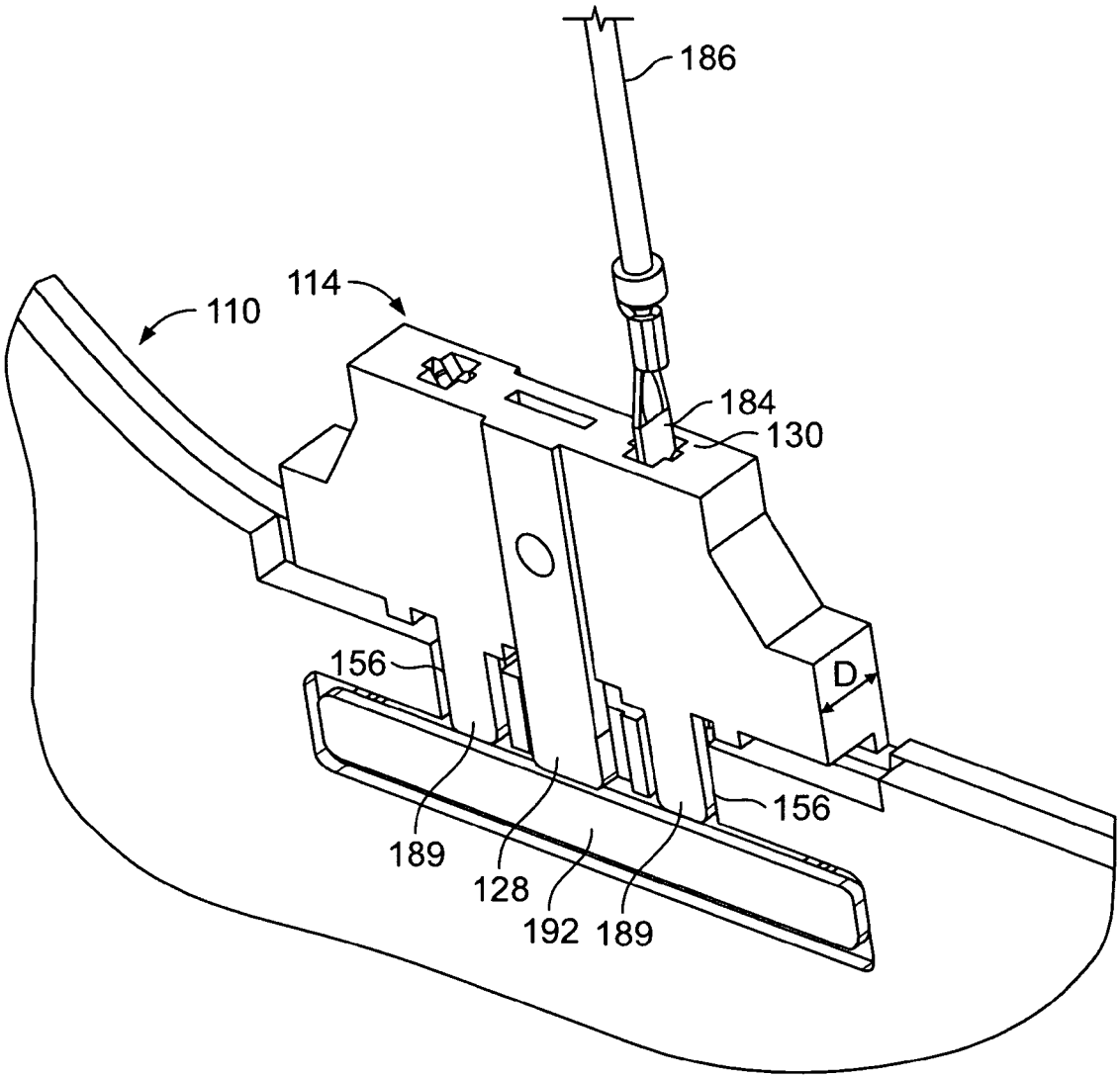
FIG. 8 illustrates a partial assembly view of the system shown in FIG. 2.

FIG. 8 illustrates a plate 110, a connector 114 installed on the plate 110, and the mating contact 184 and wire 186 engaged to the connector 114. In one embodiment, the connectors 114 are coupled to the respective plates 110 before the plates are stacked. The plate contact 170 is engaged to the plate 110 as illustrated in FIGS. 4 and 5, and the connector housing flanges 189 are received in the first plate portion slots 156 and shield the contact beams 176 to electrically isolate adjacent plates 110 and keep them from shorting in the stack. The flange 128 is received in the guide channel 157, and the flange 128 along with the mounting legs 132 support the housing 116 on the plate 110. The mating contact 184 is received in one of the receptacles 130 in the connector housing 116 to establish communication with the monitoring module 188 (FIG. 2) to monitor the voltages on the plate 110. When the plates 110 are stacked as shown in FIG. 1, mating connectors 184 may be used with any of the connector receptacles 130 to monitor the plates in the stack.

A connector assembly 100 is therefore provided which reliably connects conductive plates to external equipment while avoiding the aforementioned problems associated with known connector systems. A reliable, long term contact system is therefore provided for use with, for example, fuel cell stacks which are not compatible with existing connector systems. Connectors 114 (FIGS. 1, 2, 6 and 8) having the plate contacts 170 (FIG. 3–5) may be used singly with single plates, or multiple plate contacts 170 and connectors 114 may be used with multiple plates. Redundant contact surfaces are provided with the contact beams 174 and 176 and the oppositely directed normal forces $N_1$ and $N_2$ (FIGS. 4 and 5) of the contact beams 174 and 176 ensure mechanical and electrical connection of the plate contacts 170 with the plates 110. The retention bars 192 (FIGS. 2 and 8) provide secure attachment of the connector housings 116 to the plates 110, and the housing flanges 128 along with the mounting legs 132 (FIGS. 2 and 6) support the housings 116 on the plates 110 and the flanges 128 and 189 prevent adjacent plates 110 from shorting one another in the stack. The compliant body sections 172 of the plate contacts 170 relieve mechanical stress on the contact beams 174 and 176 of the connector 114 so that the contact beams 174 and 176 remain engaged to the plate 110 under varying operation conditions and temperatures. Superior electrical and mechanical connection to the plates 110 is therefore provided.

While the invention has been described in terms of various specific embodiments, those skilled in the art will recognize that the invention can be practiced with modification within the spirit and scope of the claims.

What is claimed is:

1. An electrical connector for mating with a self-supporting plate fabricated from a conductive material, said plate formed with a plate mounting edge and first and second sin-faces extending from the plate mounting edge, said connector comprising:

a contact comprising:

a contact mounting edge and a lead interface edge opposite said contact mounting edge;

a first contact beam and a second contact beam extending from said contact mounting edge, said first contact beam configured to engage the first surface of the self-supporting plate when passed over the plate mounting edge, and said second contact beam configured to engage the second surface of the self-supporting plate when passed over the plate mounting edge, said first and second contact beams being laterally offset from one another along said contact mounting edge, thereby mechanically and electrically interfacing said contact to said self supporting plate;

at least one lead contact extending from the lead interface edge, said lead contact configured to mate with a mating connector; and said contact comprising a substantially planar body section, a plurality of openings extending through said body section, and compliant web sections between adjacent openings, wherein said compliant web sections permit said body section to flex about said compliant web sections and relieve mechanical stress upon said first and second contact beams.

2. An electrical connector in accordance with claim 1 wherein said first contact beam comprises a pair of contact beams configured to engage the first surface of the plate, said pair of contact beams being laterally offset from said second contact beam along said contact mounting edge.

3. An electrical connector in accordance with claim 1 wherein said first contact beam comprises at least two contact beams configured to engage the first surface of the plate, said second contact beam located between said at least two contact beams on said contact mounting edge.

4. An electrical connector in accordance with claim 1 further comprising a housing and a retaining bar configured to secure said housing to the plate, said retaining bar separately provided from said housing.

5. An electrical connector in accordance with claim 1 further comprising a housing, said housing comprising an insulating flange corresponding to one of said first and second contact beams, said insulating flange configured to prevent said corresponding contact beam from contacting an adjacent plate when a plurality of plates are stacked in an electrical system.

6. An electrical connector in accordance with claim 1 wherein the plate is a bipolar plate of a fuel cell stack, said connector further comprising a housing surrounding a portion of said contact, said housing comprising at least one mounting leg configured for attachment to the bipolar plate.

7. An electrical system comprising:

a plate fabricated from a conductive material into a self supporting conductive body, the body having a mounting interface edge, a first surface extending from said mounting edge and a second surface extending from said mounting edge opposite said first surface, said plate configured for stacking in a component assembly, a connector comprising a housing configured to slidably engage said mounting interface edge, and a contact in said housing and configured to engage said first surface and said second surface of said plate, said contact comprising a compliant section comprising a plurality of openings therethrough and compliant web sections between adjacent openings; and a non-conductive retention bar, unattached to said housing and configured to retain said housing to said plate.

8. An electrical system in accordance with claim 7 wherein said retention bar includes a mounting post configured to be received in a mounting aperture in said plate.

9. An electrical system in accordance with claim 7 wherein said contact comprises a first contact beam and a second contact beam extending from said housing, said first contact beam configured to engage said first surface of said plate when passed over said plate mounting edge, and said second contact beam configured to engage said second surface of said plate when passed over said plate mounting edge.

10. An electrical system in accordance with claim 7 wherein said contact comprises a first contact beam and a second contact beam extending from said housing, said first and second contact beams being laterally offset from one another along said contact mounting edge.

11. An electrical system comprising:

a plurality of electrical components comprising self-supporting conductive plates arranged in line with one another and spaced from one another by a nominal pitch value, each of said components having a component mounting edge configured to receive an electrical connector, and a plurality of electrical connectors attached to a respective one of said electrical components, each of said plurality of electrical connectors comprising:

a housing configured to slidably engage a mounting edge of the respective electrical components;

a contact comprising first and second contact beams extending from said housing, said first and second contact beams configured to engage opposite surfaces of said plate adjacent said component mounting edge, said contact further comprising a compliant section comprising a plurality of openings therethrough and compliant web sections between adjacent openings; and a non-conductive retention bar unattached to said housing, said retention bar configured to retain said housing to the respective electrical component proximate said component mounting edge.

12. An electrical system in accordance with claim 11 wherein said component mounting edge includes first and second mounting apertures, and said retaining bar comprises first and second mounting posts extending therefrom, said mounting posts configured to be received in said first and second mounting apertures.

13. An electrical system in accordance with claim 11 wherein said contact comprises a first contact beam and a second contact beam extending from said housing, said first and second contact beams being laterally offset from one another along said component mounting edge.

14. An electrical system in accordance with claim 11 wherein said electrical components are bipolar plates configured to form a fuel cell stack.

15. An electrical system in accordance with claim 11 wherein said contact further comprises a compliant section located within said housing.

16. An electrical connector for mating with a conductive plate, said plate having a plate mounting edge, and first and second surfaces extending from the plate mounting edge, said connector comprising:

a contact comprising a contact mounting edge and a lead interface edge opposite said contact mounting edge;

a first contact beam and a second contact beam extending from said contact mounting edge, said first contact beam configured to engage the first surface of the plate when passed over the plate mounting edge, and said second contact beam configured to engage the second surface of the plate when passed over the plate mounting edge, said first and second contact beams being laterally offset from one another along said contact mounting edge; and at least one lead contact extending from the lead interface edge, said lead contact configured to mate with a mating connector;

wherein the plate is a bipolar plate of a fuel cell stack, said connector further comprising a housing surrounding a portion of said contact, said housing comprising at least one mounting leg configured for attachment to the bipolar plate.

17. An electrical system comprising:

a plurality of electrical components arranged in line with one another and spaced from one another by a nominal pitch value, each of said components having a component mounting edge configured to receive an electrical connector, wherein said electrical components are bipolar plates configured to form a fuel cell stack; and a plurality of electrical connectors attached to a respective one of said electrical components, each of said plurality of electrical connectors comprising:

a housing configured to slidably engage a mounting edge of the respective electrical components;

a contact comprising first and second contact beams extending from said housing, said first and second contact beams configured to engage opposite surfaces of said plate adjacent said component mounting edge; and a non-conductive retention bar unattached to said housing, said retention bar configured to retain said housing to the respective electrical component proximate said component mounting edge.

* * * * *